US009475628B2

(12) United States Patent
Coltri-Johnson

(10) Patent No.: US 9,475,628 B2
(45) Date of Patent: Oct. 25, 2016

(54) CARRIER PACKAGES AND METHODS OF ERECTING CARRIER PACKAGES

(75) Inventor: Andrea Coltri-Johnson, Marietta, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 408 days.

(21) Appl. No.: 11/729,375

(22) Filed: Mar. 28, 2007

(65) Prior Publication Data

US 2007/0227927 A1 Oct. 4, 2007

Related U.S. Application Data

(60) Provisional application No. 60/786,871, filed on Mar. 29, 2006.

(51) Int. Cl.

| | |
|---|---|
| ***B65D 75/00*** | (2006.01) |
| ***B65D 71/36*** | (2006.01) |
| ***B65B 5/02*** | (2006.01) |
| ***B65B 5/06*** | (2006.01) |

(52) U.S. Cl.

CPC ..... *B65D 71/36* (2013.01); *B65B 5/024* (2013.01); *B65B 5/06* (2013.01); *B65D 2571/0066* (2013.01); *B65D 2571/00141* (2013.01); *B65D 2571/00635* (2013.01); *B65D 2571/00728* (2013.01); *B65D 2571/00932* (2013.01)

(58) Field of Classification Search

CPC ..... B65D 2571/0066; B65D 2571/00728; B65D 2571/00932; B65D 71/36; B65B 5/024; B65B 5/06

USPC ..... 206/427, 429, 434, 435, 147, 430, 432, 206/155, 156, 145, 169, 167, 193, 170; 53/48.6, 48.8, 48.9, 49, 48.7, 398, 461, 53/585, 473, 467, 448, 441, 458, 479, 443, 53/531, 543, 456, 469, 452, 457, 459, 468, 53/480, 484, 486, 50, 48.3, 466, 558, 53/266.1, 564; 229/103.2

See application file for complete search history.

(56) References Cited

U.S. PATENT DOCUMENTS

| | | | | |
|---|---|---|---|---|
| 2,756,553 | A * | 7/1956 | Ferguson et al. | 53/48.1 |
| 2,796,709 | A * | 6/1957 | Bolding | 53/398 |
| 2,849,111 | A | 8/1958 | Fielding | |
| 2,922,561 | A | 1/1960 | Currivan | |

(Continued)

FOREIGN PATENT DOCUMENTS

| | | |
|---|---|---|
| BE | 671.762 | 3/1966 |
| CA | 2172379 | 12/1995 |

(Continued)

OTHER PUBLICATIONS

PCT/US2007/007797—International Search Report.
PCT/US2007/007797—Written Opinion.
European Search Report mailed Jul. 3, 2011 for related application No. EP07 754 331.2.

(Continued)

*Primary Examiner* — Jacob K Ackun
*Assistant Examiner* — Jenine Pagan
(74) *Attorney, Agent, or Firm* — Womble Carlyle Sandridge & Rice, LLP

(57) ABSTRACT

A carrier package is constructed to tightly secure articles within the package. During loading, pushing the containers into the package causes the side panels of the package to deform so that the height of the package decreases and the width of the package increases.

6 Claims, 6 Drawing Sheets

(56) References Cited

U.S. PATENT DOCUMENTS

| | | | | |
|---|---|---|---|---|
| 2,928,541 | A | 3/1960 | Fielding | |
| 3,040,491 | A * | 6/1962 | Viitanen | B65B 5/06 53/247 |
| 3,060,659 | A * | 10/1962 | Blais et al. | 53/566 |
| 3,176,902 | A | 4/1965 | Champlin | |
| 3,178,242 | A | 4/1965 | Ellis | |
| 3,237,762 | A | 3/1966 | Wood | |
| 3,252,649 | A * | 5/1966 | Graser et al. | 206/140 |
| 3,300,115 | A | 1/1967 | Schauer | |
| 3,306,519 | A | 2/1967 | Wood | |
| 3,339,723 | A | 9/1967 | Wood | |
| 3,356,279 | A | 12/1967 | Root | |
| 3,356,283 | A | 12/1967 | Champlin | |
| 3,373,867 | A | 3/1968 | Wood | |
| 3,429,496 | A | 2/1969 | Hickin | |
| 3,541,757 | A * | 11/1970 | Bertrand | 53/476 |
| 3,557,521 | A * | 1/1971 | Pierce, Jr. | 53/48.9 |
| 3,593,849 | A | 7/1971 | Helms | |
| 3,635,452 | A | 1/1972 | Helms | |
| 3,669,342 | A | 6/1972 | Funkhouser | |
| 3,688,972 | A | 9/1972 | Mahon | |
| 3,747,835 | A | 7/1973 | Graser | |
| 3,767,042 | A | 10/1973 | Ganz | |
| 3,807,624 | A | 4/1974 | Funkhouser | |
| 3,894,681 | A | 7/1975 | Arneson et al. | |
| 3,904,036 | A | 9/1975 | Forrer | |
| 3,963,121 | A | 6/1976 | Kipp | |
| 4,010,593 | A | 3/1977 | Graham | |
| 4,101,069 | A | 7/1978 | Wood | |
| 4,202,446 | A | 5/1980 | Sutherland | |
| 4,328,893 | A | 5/1982 | Oliff et al. | |
| 4,394,903 | A | 7/1983 | Bakx | |
| 4,421,232 | A * | 12/1983 | Konaka | 206/434 |
| 4,424,901 | A | 1/1984 | Lanier | |
| 4,440,340 | A | 4/1984 | Bakx | |
| 4,482,090 | A | 11/1984 | Milliens | |
| 4,508,258 | A | 4/1985 | Graser | |
| 4,519,182 | A * | 5/1985 | Lever et al. | 53/461 |
| 4,523,676 | A | 6/1985 | Barrash | |
| 4,566,593 | A | 1/1986 | Muller | |
| 4,735,315 | A | 4/1988 | Oliff | |
| 4,747,487 | A | 5/1988 | Wood | |
| 4,784,266 | A * | 11/1988 | Chaussadas | 206/434 |
| 4,796,754 | A * | 1/1989 | Chaussadas | B65D 71/12 206/150 |
| 4,804,089 | A * | 2/1989 | Wilson | 206/435 |
| 4,875,585 | A | 10/1989 | Kadleck et al. | |
| 4,901,849 | A | 2/1990 | Wilson | |
| 4,919,266 | A * | 4/1990 | McIntosh et al. | 206/434 |
| 4,966,324 | A | 10/1990 | Steel | |
| 4,972,991 | A | 11/1990 | Schuster | |
| 5,000,313 | A | 3/1991 | Oliff | |
| 5,042,660 | A | 8/1991 | Carver | |
| 5,060,792 | A | 10/1991 | Oliff | |
| 5,131,588 | A | 7/1992 | Oliff | |
| 5,180,100 | A | 1/1993 | Shimizu | |
| 5,195,676 | A | 3/1993 | LeBras | |
| 5,197,656 | A * | 3/1993 | Hoell et al. | 206/427 |
| 5,246,112 | A | 9/1993 | Stout et al. | |
| 5,297,673 | A | 3/1994 | Sutherland | |
| 5,351,878 | A | 10/1994 | Cooper | |
| 5,395,043 | A * | 3/1995 | Bacques et al. | 229/109 |
| 5,421,458 | A * | 6/1995 | Campbell | 206/434 |
| 5,472,090 | A | 12/1995 | Sutherland | |
| 5,472,138 | A | 12/1995 | Ingram | |
| 5,485,915 | A * | 1/1996 | Harris | 206/147 |
| 5,505,372 | A | 4/1996 | Edson et al. | |
| 5,542,536 | A | 8/1996 | Sutherland | |
| 5,551,556 | A | 9/1996 | Sutherland | |
| 5,558,212 | A | 9/1996 | Sutherland | |
| 5,558,213 | A | 9/1996 | Sutherland | |
| 5,597,071 | A | 1/1997 | Sutherland | |
| 5,609,251 | A | 3/1997 | Harris | |
| 5,664,401 | A | 9/1997 | Portrait et al. | |
| 5,682,995 | A | 11/1997 | Sutherland | |
| 5,692,614 | A | 12/1997 | Harris | |
| 5,778,630 | A | 7/1998 | Portrait et al. | |
| 5,853,088 | A | 12/1998 | Saulas et al. | |
| 5,855,318 | A | 1/1999 | Baxter | |
| 5,896,728 | A * | 4/1999 | Domino | B65B 43/365 53/252 |
| 5,931,300 | A * | 8/1999 | Sutherland | 206/427 |
| 5,937,620 | A | 8/1999 | Chalendar | |
| 5,941,453 | A | 8/1999 | Oliff | |
| 5,943,847 | A | 8/1999 | Chalendar | |
| 5,947,367 | A | 9/1999 | Miller et al. | |
| 5,975,286 | A | 11/1999 | Oliff | |
| 6,019,220 | A | 2/2000 | Sutherland | |
| 6,021,898 | A | 2/2000 | Sutherland | |
| 6,021,899 | A | 2/2000 | Sutherland | |
| 6,085,969 | A * | 7/2000 | Burgoyne | 229/109 |
| 6,109,438 | A | 8/2000 | Sutherland | |
| 6,155,480 | A | 12/2000 | Botsford et al. | |
| 6,158,586 | A | 12/2000 | Muller | |
| 6,227,367 | B1 | 5/2001 | Harrelson et al. | |
| 6,283,293 | B1 | 9/2001 | Lingamfelter | |
| 6,289,651 | B1 | 9/2001 | Le Bras | |
| 6,315,123 | B1 | 11/2001 | Ikeda | |
| 6,378,697 | B1 | 4/2002 | Sutherland et al. | |
| 6,550,616 | B2 | 4/2003 | Le Bras | |
| 6,789,673 | B2 | 9/2004 | Lingamfelter | |
| 6,811,525 | B2 | 11/2004 | Culpepper | |
| 6,866,185 | B2 | 3/2005 | Harrelson | |
| 6,948,651 | B2 | 9/2005 | Ikeda | |
| 6,981,631 | B2 | 1/2006 | Fogle et al. | |
| 6,988,617 | B2 | 1/2006 | Gomes et al. | |
| 7,007,800 | B2 | 3/2006 | Le Bras | |
| 7,159,759 | B2 | 1/2007 | Sutherland | |
| 7,448,492 | B2 | 11/2008 | Sutherland | |
| 2003/0000182 | A1 | 1/2003 | Portrait et al. | |
| 2003/0132130 | A1 | 7/2003 | Le Bras | |
| 2004/0000582 | A1* | 1/2004 | Sutherland | 229/103.2 |
| 2004/0011674 | A1 | 1/2004 | Theelen | |
| 2004/0089671 | A1 | 5/2004 | Miller | |
| 2004/0099542 | A1* | 5/2004 | Sutherland | 206/193 |
| 2004/0188277 | A1 | 9/2004 | Auclair | |
| 2004/0188301 | A1 | 9/2004 | Gomes | |
| 2004/0243277 | A1 | 12/2004 | Bonnain et al. | |
| 2004/0254666 | A1 | 12/2004 | Bonnain et al. | |
| 2005/0001020 | A1 | 1/2005 | Gamier | |
| 2005/0103652 | A1 | 5/2005 | Wilkins | |
| 2005/0178791 | A1 | 8/2005 | Miller | |
| 2005/0194430 | A1 | 9/2005 | Auclair et al. | |
| 2006/0191811 | A1 | 8/2006 | Fogle et al. | |
| 2006/0255108 | A1 | 11/2006 | Shmagin | |
| 2007/0017829 | A1* | 1/2007 | Sutherland | 206/170 |
| 2007/0241017 | A1* | 10/2007 | Sutherland et al. | 206/434 |

FOREIGN PATENT DOCUMENTS

| | | |
|---|---|---|
| DE | 91 04 905.9 | 6/1991 |
| DE | 92 03 858.1 | 5/1992 |
| EP | 0 459 658 A1 | 12/1991 |
| EP | 0 509 749 A1 | 10/1992 |
| EP | 0520 411 A1 | 12/1992 |
| FR | 2 698 074 | 5/1994 |
| JP | 5-112373 | 5/1993 |
| JP | 9507821 | 12/1997 |
| JP | 41-18199 | 7/2008 |
| WO | 9614253 | 5/1996 |
| WO | WO 97/27124 | 7/1997 |
| WO | WO 02/102208 A1 | 12/2002 |
| WO | WO 03/008292 A2 | 1/2003 |
| WO | WO2004/087507 | 10/2004 |
| WO | WO 2005/042370 A1 | 5/2005 |
| WO | WO2005.092735 | 10/2005 |
| WO | WO 2005/042370 A1 | 12/2005 |

OTHER PUBLICATIONS

Notification of Reason for Refusal for JP 2009-503006 dated Feb. 27, 2012 and English Translation.

* cited by examiner

CARRIER PACKAGES AND METHODS OF ERECTING CARRIER PACKAGES

RELATED APPLICATION

This application claims the benefit of U.S. Provisional Application No. 60/786,871, filed Mar. 29, 2006, the entire contents of which are hereby incorporated by reference.

BACKGROUND

Carrier packages are typically formed by wrapping a carrier blank around a group of containers and securing the ends of the blank together. The containers are held in place by the wrapped carrier. Conventional carrier packages, however, may not be sufficiently tightly wrapped, causing the wrapped package to have low structural rigidity and possibly resulting in containers shifting within the package and/or falling out of the package.

SUMMARY

According to an aspect of the invention, a carrier package comprises a plurality of articles accommodated within a carrier having a bottom panel, a first side panel, a second side panel, and a top panel. The articles are loaded into the carrier such that sections of the first and second side panels are deformed during loading.

According to another exemplary aspect of the invention, a carrier package is constructed from a blank having a bottom panel, a first side panel, a second side panel, and a top panel. The blank is designed to accommodate articles arranged in n rows and m columns, where n and m are positive, non-zero integers. The bottom panel has a width that is less than n times a characteristic width dimension of the articles.

According to yet another exemplary aspect of the invention, a partially erected carrier (e.g., substantially tubular form) is loaded with articles arranged in a staggered or offset configuration. When the articles are pushed into the partially erected carrier and assume a rectangular n×m configuration, the sides of the carrier deform outwardly. As the sides of the carrier deform, the height of the partially erected carrier decreases and the width of the carrier increases.

Those skilled in the art will appreciate the above stated advantages and other advantages and benefits of various additional embodiments after reading the following detailed description of the embodiments with reference to the below-listed drawing figures.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

Figure 1:
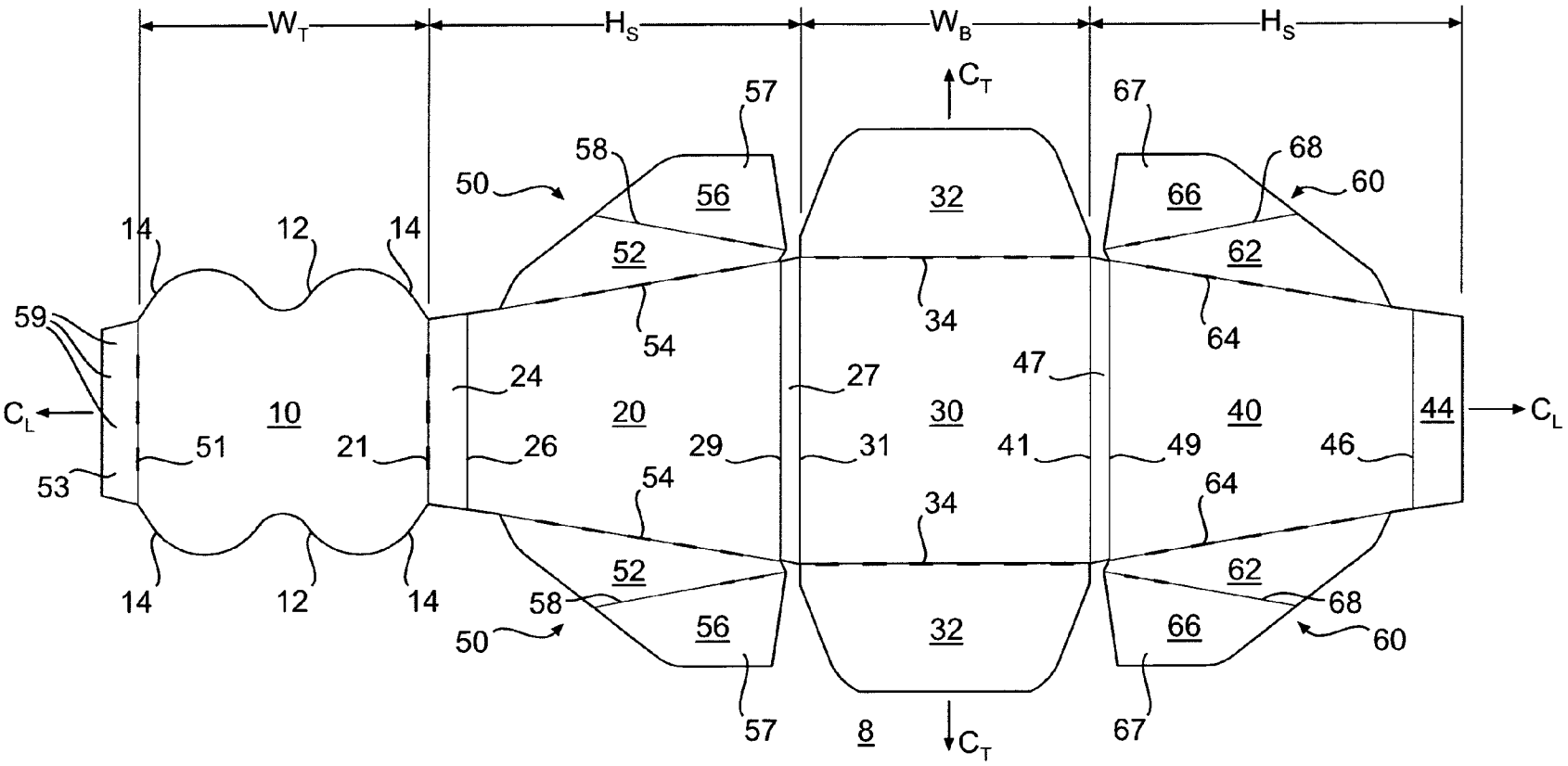
FIG. 1 is a plan view of a carrier blank used to form a carrier package according to a first embodiment of the invention.

FIG. 1 is a plan view of a carrier blank 8 used to form a carrier 120 according to a first embodiment of the invention. The carrier 120 accommodates a plurality of articles such as containers C to form a carrier package 150 (the erected carrier package 150 is illustrated in FIGS. 5-8). As shown in FIG. 1, the carrier blank 8 may be wholly or partially symmetric about a longitudinal centerline CL, and partially symmetric about a transverse centerline CT. Therefore, certain elements in the drawing figures may share common reference numerals in order to reflect the whole and/or partial longitudinal and transverse symmetries of the blank 8.

In this specification, the terms "lower," "bottom," "side," "end," "upper" and "top" indicate spatial orientations determined in relation to fully erected carriers placed in upright configurations. For the purposes of illustration and not for the purpose of limiting the scope of the invention, the following detailed description describes generally cylindrical sixteen ounce beverage container cans as disposed within the exemplary carrier embodiment. Other types of containers not illustrated, and other articles, for example, may be accommodated in carrier packages constructed, loaded and/or erected according to the principles of the present invention. The illustrated blank 8 is configured to form a carrier for accommodating four beverage containers C in a 2×2 (two rows and two columns) arrangement, although other container arrangements can be accommodated according to the principles of the present invention.

Referring to FIG. 1, the blank 8 comprises a top panel 10 foldably connected to a first side panel 20 at a first transverse fold line 21, a bottom panel 30 foldably connected to the first side panel 20 at a second transverse fold line 31, and a second side panel 40 foldably connected to the bottom panel 30 at a third transverse fold line 41. An adhesive flap 53 may be foldably connected to the top panel 10 at a fourth transverse fold line 51. Alternatively, an adhesive flap (not illustrated) may be connected to the second side panel 40 at the opposite end of the blank 8.

A bottom end flap 32 may be foldably connected to each end of the bottom panel 30 at a longitudinally extending fold line 34. The bottom end flaps 32 serve to partially close the bottom ends of the erected carrier package 150 (illustrated in FIGS. 5-8). A first web portion 50 may be foldably connected to each end of the first side panel 20 at an oblique fold line 54. A second web portion 60 may be foldably connected to each end of the second side panel 40 at an oblique fold line 64. Each first web portion 50 comprises a first proximal web panel 52 foldably connected to the first side panel 20 at an oblique fold line 54 and a first distal web panel 56 foldably connected to a first proximal web panel 52 at an oblique fold line 58. Each second web portion 60 comprises a second proximal web panel 62 foldably connected to the second side panel 40 at an oblique fold line 64 and a second distal web panel 66 foldably connected to a second proximal web panel 62 at an oblique fold line 68. In the carrier package 150, the first and second web portions 50, 60 are adhered to the bottom end flaps 32 and serve to partially close the ends of the carrier package 150.

The top panel 10 may be formed from a generally square or rectangular shaped section of board, with one or more curved cutout sections 12 and/or curved corner sections 14 cut from the board. The curved sections 12, 14 of the top panel 10 can be configured, for example, so that the contour of the top panel 10 generally conforms to the contour of containers C accommodated in the carrier package 150 (FIGS. 5-8).

According to one exemplary aspect of the present invention, the first and second side panels 20, 40 of the blank 8 may be constructed to flex and/or bend or otherwise deform at one or more locations during erection so that the resulting carrier package 150 is tightly wrapped around articles accommodated within the carrier package. As shown in FIG. 1, the first side panel 20 includes a first upper section 24 foldably connected at a transverse fold line 26, and a first lower section 27 foldably connected at a transverse fold line 29. Similarly, the second side panel 40 includes a second upper section 44 foldably connected at a transverse fold line 46, and a second lower section 47 foldably connected at a transverse fold line 49. The upper and lower sections 24, 27, 44, 47 allow the first and second side panels 20, 40 to deform during loading of the carrier package 150, as is discussed in further detail below.

The lines of disruption or weakening 21, 31, 41, 51, 26, 29, 46, 49, 54, 64 formed in the blank 8 may be, for example, score lines, crease lines, cut-space lines, cut-crease lines, combinations thereof, or other lines of disruption that facilitate folding or bending of the blank 8. In the illustrated exemplary blank embodiment, the transverse fold lines 26, 29, 46, 49 are crease lines, the fold lines 21, 51, 54, 64 are cut-crease lines, and the oblique fold lines 58, 68 are crease lines having spaced cut sections.

The longitudinal dimension $W_B$ in FIG. 1 indicates a width of the bottom panel 30, and the longitudinal dimension $H_S$ indicates an initial height of the first and second side panels 20, 40, before the carrier is fully loaded with containers C. The longitudinal dimension $W_T$ is the width of the top panel 10. $W_T$ and $W_B$ may be, for example, equal.

Figure 2:
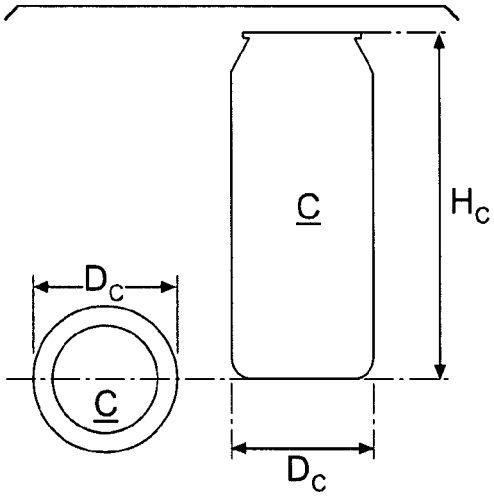
FIG. 2 illustrates an exemplary container suitable for use in a carrier package according to the first embodiment.

FIG. 2 illustrates top and side views of an exemplary article in the form of a beverage container C suitable for loading in the carrier package 150. The container C has a height $H_C$ and a diameter $D_C$. According to an exemplary aspect of the present invention, the initial, preload height $H_S$ of the first and second side panels 20, 40 in the partially erected carrier is greater than the container height $H_C$. According to another exemplary aspect, the width $W_B$ of the bottom panel 30 and the width $W_T$ of the top panel 10 are less than n times a characteristic width dimension (in this example the container diameter $D_C$) of a container in a carrier package accommodating a rectangular n×m container arrangement. The term "characteristic width dimension" can be defined as the largest diameter of a generally cylindrical container, which diameter may be located at a middle section along the height of the container. n and m are positive integers, with n indicating the number of rows of containers. According to the exemplary embodiments, the number of rows of containers is counted across the ends of the carrier package 150, and the number of columns is counted along the sides of the carrier package. Using these dimensions, the construction of the carrier blank 8 and the method of erection of the carrier package allow the carrier package to be more tightly wrapped than conventional carrier packages.

An exemplary method of erection of the carrier package 150 is discussed below with reference to FIGS. 3-4F. In the exemplary method, the carrier blank 8 may be provided with glue or other adhesives at the locations 59, 57, 67 on the exterior surfaces of the adhesive flap 53 and the first and second distal web panels 56, 66, respectively, as shown in FIG. 1.

Figure 3:
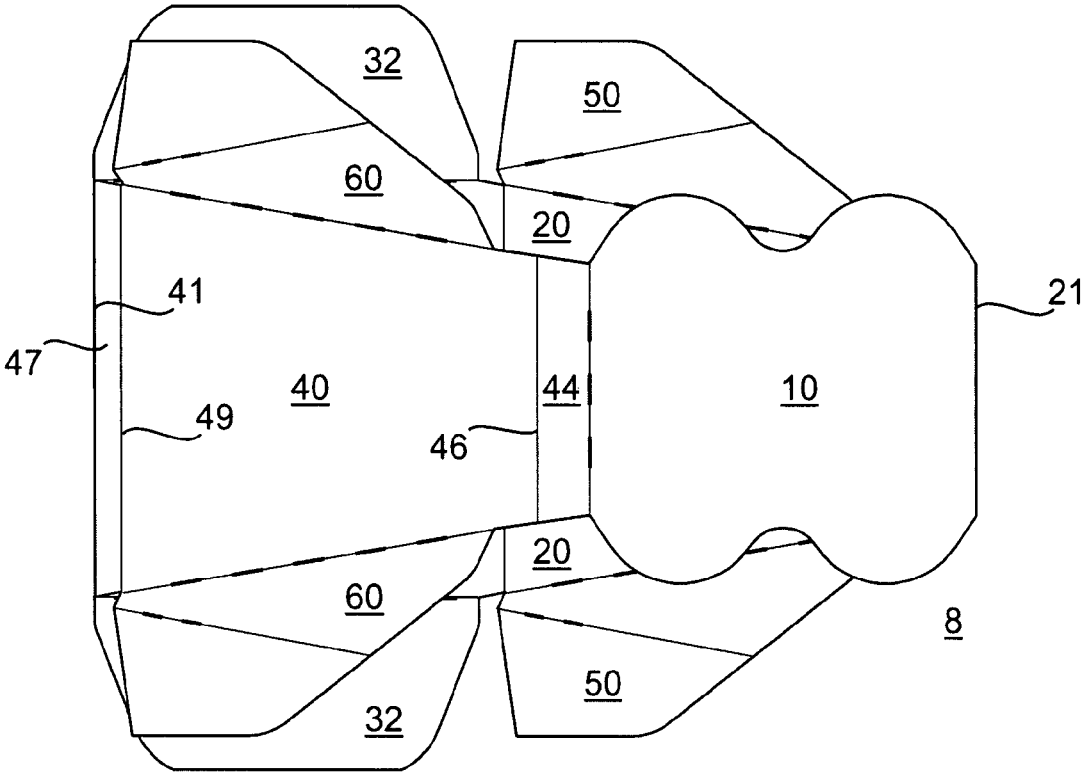
FIG. 3 illustrates the carrier blank of FIG. 1 folded and glued and in a partially erected state.

FIG. 3 illustrates the carrier blank 8 folded and glued and in a partially erected state. In FIG. 3, the carrier blank 8 is folded about the transverse fold lines 41 and 21, and the exterior side of the adhesive flap 53 (FIG. 1) is brought into contact with the interior side of the second side panel 40, specifically at the second upper section 44 of the panel 40. Glue or other adhesive may be applied to the exterior side of the adhesive flap 53 and/or to the interior side of the second upper section 44 of the second side panel 40 in order to adhere the adhesive flap 53 and the second side panel 40 together. Thereafter, the partially erected carrier blank 8 is erected into a sleeve-like shape by folding along lines 21, 31, 41, 51 to provide the configuration schematically shown in FIGS. 4A-4C.

FIGS. 4A-4F are partially schematic diagrams of the partially erected carrier blank 8 (e.g., substantially tubular form) being loaded with containers $C_1$-$C_4$ and the ends of the blank being closed. In this example, the containers $C_1$-$C_4$ may generally correspond in shape and dimensions to the container C illustrated in FIG. 2. In the exemplary n×m article arrangement, four containers $C_1$-$C_4$ are loaded into a partially erected tubular carrier form in the offset or staggered diagonal 2×2 arrangement shown in FIG. 4C. Other article arrangements, including 3×3, 4×4, etc. are within the scope of the present invention. The first and second web portions 50, 60 are not shown in FIG. 4C for clarity of illustration.

Figure 4A:
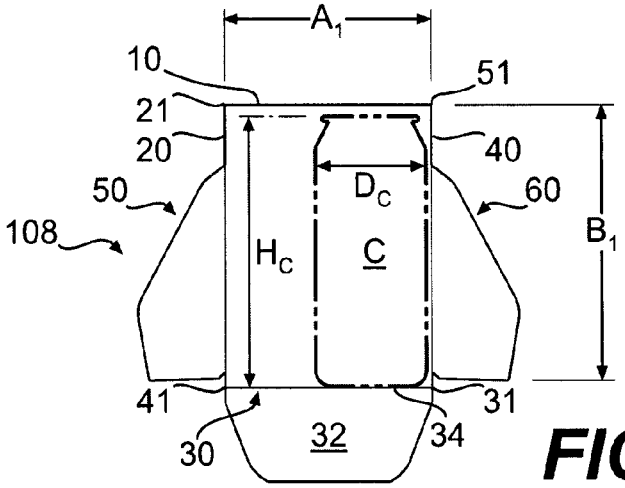
FIGS. 4A-4F are schematic diagrams of the carrier blank being erected and loaded with containers.

FIG. 4A illustrates the glued carrier blank 8 opened up into a generally tubular upright form 108 with a first container $C_1$ loaded into the tubular carrier form. At least one end of the tubular form 108 is open to allow insertion of the containers $C_1$-$C_4$. Prior to loading, the partially erected carrier 108 has an overall width $A_1$ and an overall height $B_1$. Referring also to FIG. 1, the overall width $A_1$ of the partially erected carrier 108 may generally correspond to the longitudinal width $W_B$ of the bottom panel 30 and the width $W_T$ of the top panel 10. In a carrier package accommodating an n×m article arrangement, the widths $W_B$ and $W_T$ are selected to be less than n times a characteristic width dimension of the articles to be loaded, which in this example is the largest diameter $D_C$ of the generally cylindrical containers $C_1$-$C_4$. The pre-load height $B_1$ of the partially erected carrier 108 may correspond to the height $H_S$ of the side panels 20, 40. The initial carrier height $B_1$ is greater than the article height $H_C$. As shown in FIGS. 4A-4D, during loading, one or more of the web portions 50, 60 and/or the bottom end flaps 32 may be folded outwardly and away from the open end of the tubular carrier form 108 to facilitate loading of the containers $C_1$-$C_4$ into the tubular form. The web portions 50, 60 and/or the flap 32 may alternatively, for example, extend forward from the tubular form.

Figure 4B:
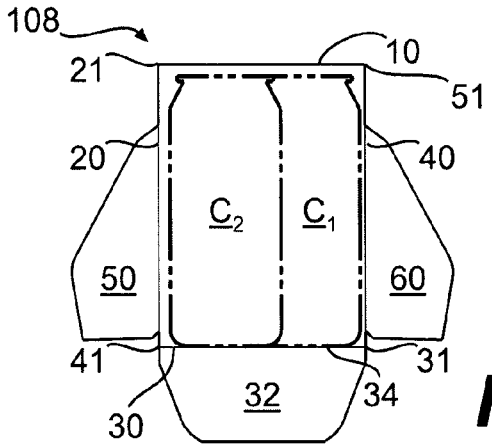
Figure 4C:
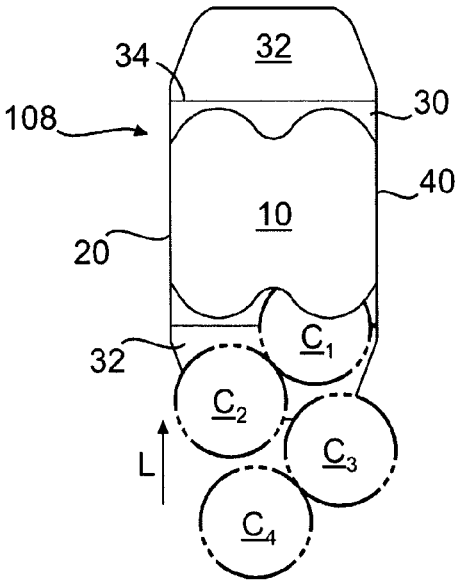

FIG. 4B shows a second container $C_2$ loaded into the partially erected tubular carrier form 108 after loading of the first container $C_1$. As shown in FIGS. 4B and 4C, the containers $C_1$, $C_2$ partially overlap when viewed from the open end of the carrier. Third and fourth containers $C_3$, $C_4$ are similarly staggered as they are pushed into the tubular carrier form 108 after the first two containers $C_1$, $C_2$. FIG. 4C illustrates the staggered arrangement of the containers $C_1$-$C_4$ as they are loaded into the carrier 108 in the direction L. The four containers $C_2$-$C_4$ may be loaded into the carrier 108 as a staggered unit or group as shown in FIG. 4C. A bar or other form of obstruction (not shown) may be placed against the open back end of the tubular carrier form 108 during loading so as to prevent the containers $C_1$-$C_4$ from being pushed through the open end of the tubular carrier form 108. A bar or arm, etc. (not illustrated), may be used to push the containers $C_1$-$C_4$ into the tubular form 108.

Figure 4D:
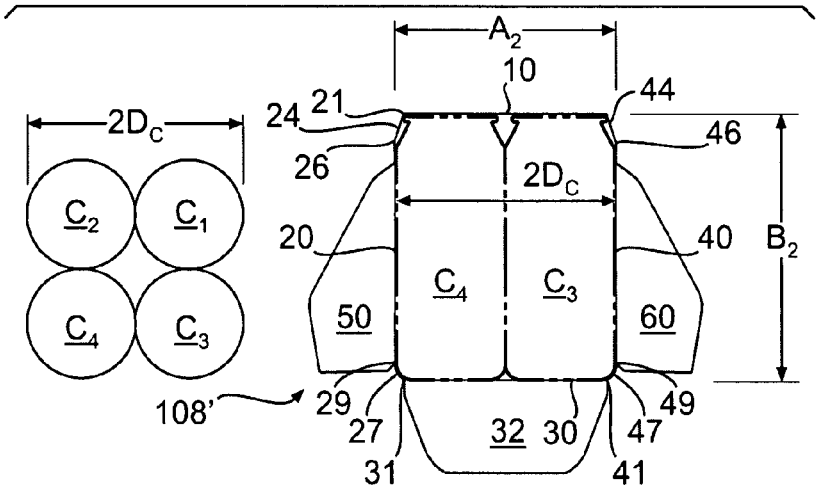

Referring to FIG. 4D, the containers $C_1$-$C_4$ are pressed into the partially erected tubular carrier form 108 so that they move from the offset or staggered diagonal orientation of FIG. 4C and into a generally rectangular 2×2 arrangement within the partially erected carrier. The 2×2 arrangement of the containers $C_1$-$C_4$ is shown to the right in FIG. 4D. The obstruction (not illustrated) at the opposite open end of the form 108 biases the other side of the group of containers $C_1$-$C_4$ so that they may be pressed firmly into the carrier form 108. As the containers $C_1$-$C_4$ are forced to align into (e.g., as they are arranged into) a side-by-side rectangular 2×2 matrix configuration, the middle portions of the first and second side panels 20, 40 are pressed or deformed outwardly by the sides of the containers C. As the middle portions of the first and second side panels 20, 40 are pressed outwardly, the first side panel 20 deforms at the first upper and lower sections 24, 27, and the second side panel 40 deforms at the second upper and lower sections 44, 47. The resultant deformation that occurs during the loading causes the overall width of the partially erected carrier to increase from $A_1$ (FIG. 4A) to $A_2$. At the same time, the overall height of the carrier decreases from $B_1$ (FIG. 4A) to $B_2$. The first upper and lower sections 24, 27 therefore deform out of plane with respect to (e.g., may become oblique with respect to) the center remainder section of the first side panel 20, and the second upper and lower sections 44, 47 deform out of plane with respect to (e.g., may become oblique with respect to) the center remainder section of the second side panel 40. The partially erected carrier having the post-loaded width dimension $A_2$ and post-loaded height dimension $B_2$ is indicated by the reference number 108'.

According to one aspect of the invention, the post-loading width $A_2$ of the carrier 108' can generally approximate the container diameter $D_C$ times the number n of rows of containers C accommodated in the carrier. For example, as illustrated in FIG. 4D, the width of the partially erected carrier 108' is approximately two times the container diameter $D_C$, with some allowance made for board caliper and bowing of the side panels 20, 40, etc. The initial height $B_1$ of the pre-load carrier decreases so that it generally approximates the container height $H_C$ and so that the top panel 10 rests relatively tightly over the tops of the containers $C_1$-$C_4$, as shown in FIG. 4D.

Figure 4E:
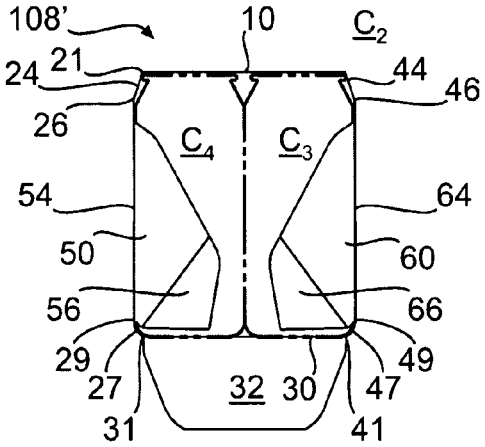
Figure 4F:
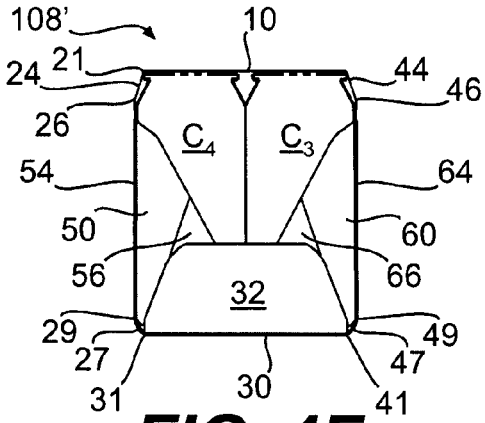

After loading of the containers $C_1$-$C_4$ into the partially erected carrier 108', the loaded partially erected carrier 108' is moved transversely from the loading position to folding/gluing station(s). Referring to FIG. 4E, the first and second web portions 50, 60 at one end of the post-loaded partially erected carrier 108' are folded inwardly about the oblique fold lines 54, 64, respectively, so that they extend across the open end of the carrier. Glue or other adhesive may be applied to the exterior of the first and second distal web panels 56, 66 and/or to the interior side of the bottom end flap 32. Referring to FIG. 4F, the bottom end flap 32 is folded upwardly and adhered to exterior sides of the first and second distal web panels 56, 66. The web portions 50, 60 and the bottom end flap 32 at the opposite end of the carrier may be similarly adhered together.

Figure 5:
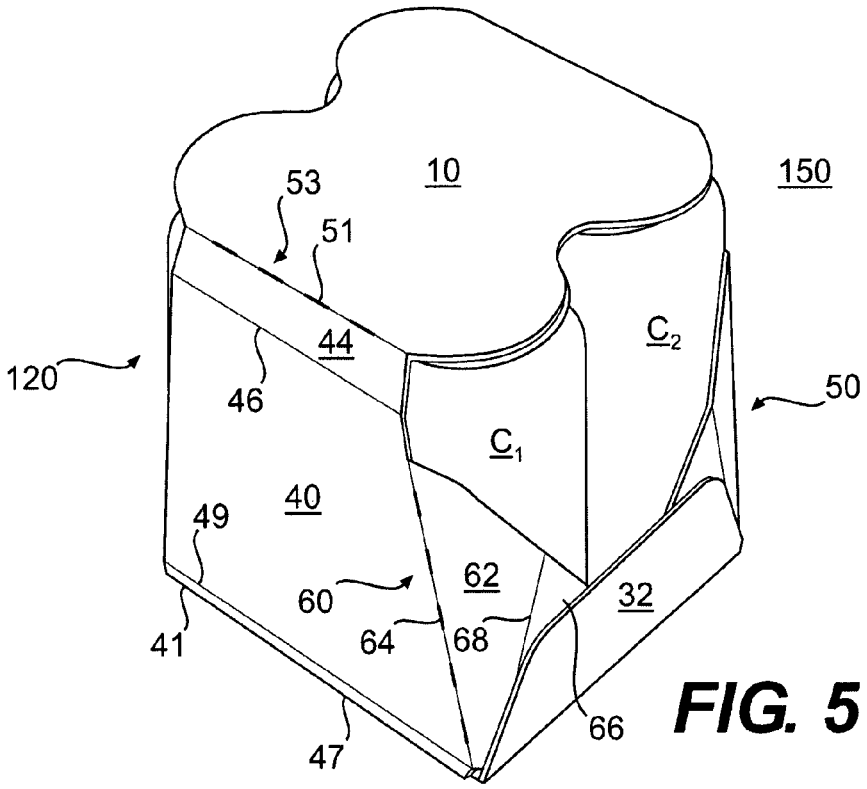
FIG. 5 illustrates the erected carrier package according to the first embodiment of the invention.
Figure 6:
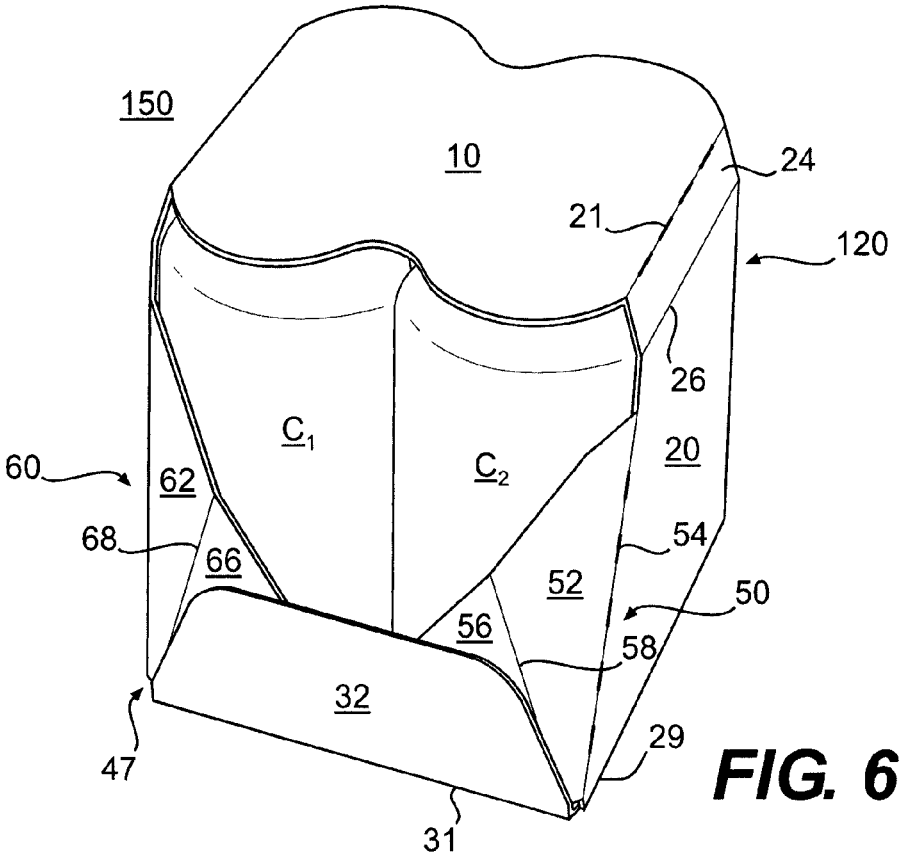
FIG. 6 illustrates the erected carrier package.

FIGS. 5 and 6 illustrate the carrier blank 8 formed into an erected carrier 120 and accommodating the four containers $C_1$-$C_4$, forming a carrier package 150. The containers $C_1$-$C_4$ are tightly wrapped at their sides by the side panels 20, 40, at their tops by the top panel 10, and at their bottoms by the bottom panel 30. The ends of the carrier package 150 are partially closed by the first web portions 50, the second web portions 60, and the bottom end flaps 32. A predetermined portion of the upper portions of the containers $C_1$-$C_4$ may remain visible through the partially closed ends of the carrier package 150.

Figure 7:
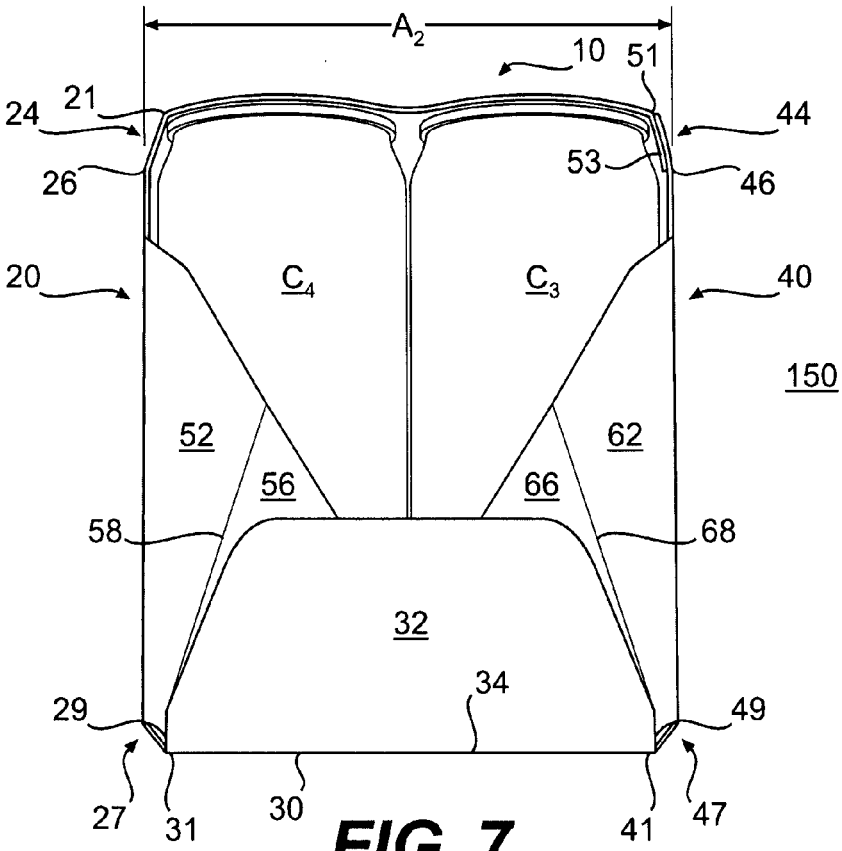
FIG. 7 is an end view of the carrier package.
Figure 8:
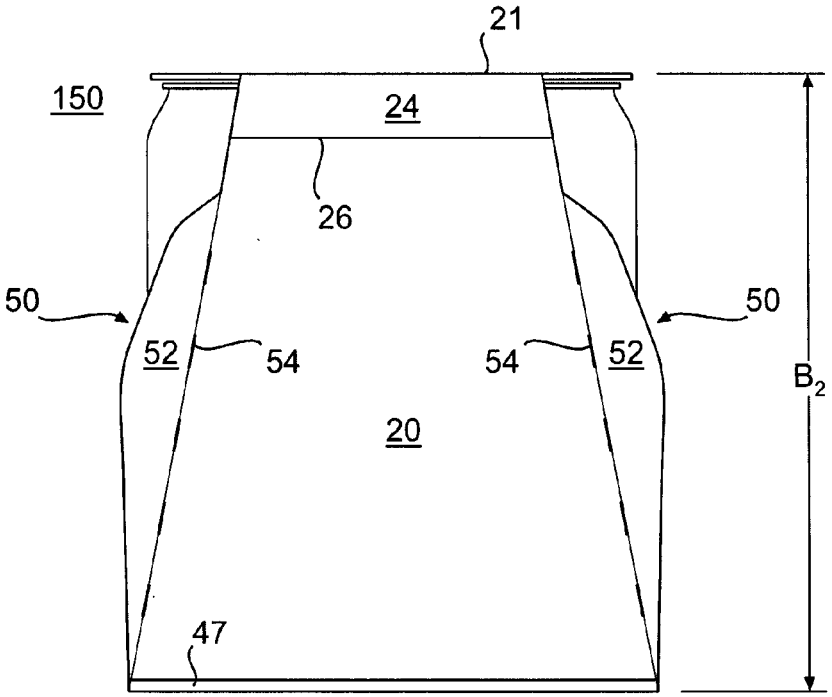
FIG. 8 is a side view of the carrier package.

FIG. 7 illustrates one end of the carrier package 150 and FIG. 8 illustrates one side of the carrier package. FIGS. 7 and 8 illustrate the deformation of the first and second side panels 20 and 40 at the upper and lower sections 24, 27 and 44, 47, respectively, caused by the carrier loading process. During loading, the first upper and lower sections 24, 27 deform out of the plane of the remaining, central portion of the first side panel 20. Similarly, the second upper and lower sections 44, 47 deform out of the plane of the remaining, central portion of the second side panel 40. The first upper section 24 generally folds or bends at the transverse fold lines 21, 26 and the first lower section 27 folds at the transverse fold lines 29, 31 so that the sections 24, 27 are oriented at a nonzero angles with respect to vertical. Similarly, the second lower section 47 folds at the transverse fold lines 49, 41 so that the section 47 is oriented at a nonzero angle with respect to vertical. The second upper section 44 generally folds or bends at the transverse fold line 46, while the adhesive panel 50 connecting the top panel 10 to the second upper section 44 folds or bends at the fold line 51, with the second upper section 44 assuming a nonzero orientation with respect to vertical.

Referring again to FIG. 2 and to FIG. 7, the generally cylindrical containers $C_1$-$C_4$ are of smaller diameter at their tops than at their midsections where they have the characteristic diameter $D_C$. The diameters of the tops of the containers $C_1$-$C_4$ decrease at frustoconical top portions of the containers. The upper sections 24, 44 of the first and second side panels 20, 40 slope inwardly toward the top panel 10 to generally conform to the profiles of the frustoconical sections at the tops of the containers $C_1$-$C_4$. The bottom edges of the containers $C_1$-$C_4$ also continuously decrease in diameter along a generally curved exterior profile. The lower sections 27, 47 of the first and second side panels 20, 40 slope inwardly toward the bottom panel 30 to generally conform to the bottom edges of the containers $C_1$-$C_4$.

In FIGS. 5-8, the sections 24, 27, 44, 47 of the panels 20, 40 are illustrated as retaining generally planar configurations after loading of the carrier package 150. The sections 24, 27, 44, 47 may, however, bow or otherwise deform during loading due to the stresses of pressing the containers $C_1$-$C_4$ into the partially erected carrier 108. While the central remainder sections of the side panels 20, 40 are illustrated as planar members extending generally vertically, the remainder of the side panels 20, 40 may also bow or otherwise deform to some degree.

The ends of the carrier package 150 can be partially open. The first and second web portions 50, 60 and the bottom end flaps 32 can be constructed, for example, to expose predetermined portions of the containers $C_1$-$C_4$. The first and second web portions 50, 60 may also be constructed to partially wrap around the sides of the containers $C_1$-$C_4$ within the carrier package 150. During closing of the ends of the carrier package 150, the first web portions 50 may fold or bend slightly at the oblique fold lines 58, and the web panels 52, 56 may additionally deform to wrap around and/or generally conform to the exterior surfaces of the containers C. Similarly, the second web portions 60 may fold or bend at the oblique fold lines 68 and the web panels 62, 66 can deform when pressed against the sides of the containers $C_1$-$C_4$.

In the above embodiments, the carrier package 150 is shown as accommodating generally cylindrical beverage cans. Other types of articles, however, can be accommodated within a carrier package according to principles of the present invention. The dimensions of the blank 8 may also be altered, for example, to accommodate various article forms.

Varying numbers of columns and rows of articles such as containers C can be accommodated in carrier packages constructed according to the principles of the present invention. For example, the top panel 10, the bottom panel 30 and the bottom flaps 32 can be lengthened along the longitudinal direction of the blank 8 (measured from left to right in FIG. 1) in order to accommodate additional rows of containers C. In one such embodiment, a carrier may be constructed that accommodates six containers arranged in three rows and two columns (3×2) or two rows and three columns (2×3). In general, any n×m (where n and m are positive integers) arrangement of articles can be accommodated within carrier packages according to the present invention.

In FIG. 1, the upper and lower sections 24, 44, 27, 47 defined in the side panels 20, 40 are each illustrated as defined by a pair of transverse fold lines. Each of the first and second side panels 20, 40 can include, however, sections at either or both of their upper and lower portions that are defined by alternate forms of lines of disruption. For example, a deformable section can be defined in a side panel by a plurality of relatively closely spaced parallel transverse lines of disruption. In this embodiment, the deformable upper and lower sections of the side panels could deform according to an upper or lower contour of an article retained in the carrier. For example, the lower sections 27, 47 could be defined by a plurality of spaced fold lines so that the side panels 20, 40 conform closely to the curved bottom edges of the containers.

Apertures could be cut in the upper and/or lower sections of the side panels to allow a portion of an article accommodated within the carrier package to partially extend through the side panels of the carrier.

The pre-load width $A_1$ and height $B_1$ illustrated in FIG. 4A change during loading so that they assume the values $A_2$ and $B_2$ illustrated in FIGS. 7 and 8. According to one embodiment, the preload width $A_1$ may increase by at least 3% to post-load width $A_2$, and the height $B_1$ may decrease by at least 1% to $B_2$ during loading. According to another embodiment, the width $A_1$ may increase by at least 5% and the height $B_1$ may decrease by at least 2% during loading.

In accordance with the above-described embodiments, the blank 8 may be constructed of paperboard of a caliper such that it is heavier and more rigid than ordinary paper. The blank can also be constructed of other materials, such as cardboard, hard paper, or any other material having properties suitable for enabling the carrier to function at least generally as described above.

The blank can be laminated to or coated with one or more sheet-like materials at selected panels or panel sections. Interior and/or exterior sides of the blank can be coated with a clay coating. The clay coating may then be printed over with product, advertising, price coding, and other information or images. The blank may then be coated with a varnish to protect information printed on the blank. The blank may also be coated with, for example, a moisture barrier layer, on either or both sides of the blank.

In accordance with the exemplary embodiment of the present invention, a fold line can be any substantially linear, although not necessarily straight, form of disruption or weakening in the blank that facilitates folding or bending therealong. More specifically, but not for the purpose of narrowing the scope of the present invention, examples of fold lines include: score lines; crease lines; a cut or a series of cuts that extend partially into and/or completely through the material along a desired line of weakness; and various combinations of these features.

For purposes of the description presented herein, the term "line of disruption" or "line of weakening" can be used to generally refer to a cut line, a score line, a tear line, a crease line, perforations (e.g., a series of spaced cuts), a fold line, or other disruptions formed in a blank, and overlapping and sequential combinations thereof.

In the present specification, a "panel" or "flap" need not be flat or otherwise planar. A "panel" or "flap" can, for example, comprise a plurality of interconnected generally flat or planar sections.

The above embodiments may be described as having one or panels adhered together by glue during erection of the dispensing carrier embodiments. The term "glue" is intended to encompass all manner of adhesives commonly used to secure dispensing carrier panels in place.

The description is not intended to limit the invention to the form disclosed herein. Also, it is intended that the appended claims be construed to include alternative embodiments, not explicitly defined in the detailed description.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. A sleeve for forming a carrier package, the sleeve comprising:

a generally tubular form defining an interior space and an at least partially open first end;

a plurality of panels at least partially extending around the interior space of the sleeve, the plurality of panels comprising a bottom panel, a top panel, a first side panel, and a second side panel; and at least two containers disposed at least partially in the interior space of the sleeve, each container having a top end, wherein the at least two containers are positioned in an offset arrangement with at least one first container in a first row and at least one second container in a second row, wherein each respective one of the at least two containers is spaced apart from the at least partially open first end by a respective distance, the respective distance varies for each of the at least two containers, and the at least one first container in the first row is spaced apart from the second side panel and the at least one second container in the second row is spaced apart from the first side panel;

wherein the sleeve is in a pre-load configuration in which the top panel of the sleeve is vertically spaced apart from the top ends of the containers;

wherein the sleeve is positionable from the pre-load configuration to a loaded configuration in which the top panel of the sleeve is at least partially in contact with the top ends of the respective containers.

2. The sleeve of claim 1, further comprising a sleeve width measured across the first end of the sleeve, the sleeve width being less than two times a characteristic width dimension of the containers.

3. The sleeve of claim 2, wherein the sleeve width is substantially equal to two times the characteristic width dimension of the containers in the loaded configuration of the sleeve.

4. The sleeve of claim 2, wherein the top panel has a top panel width approximately equal to the sleeve width.

5. The sleeve of claim 1, wherein each container of the at least two containers comprises a generally cylindrical middle portion extending between a top portion and a bottom portion, the middle portion of one container contacts a respective adjacent container, and the top portion and the bottom portion of each container has a generally smaller diameter that the respective middle portion.

6. The sleeve of claim 2, wherein the characteristic width dimension of each of the containers is the maximum width dimension of the respective containers.

* * * * *